US005516447A

United States Patent [19]

Bauer et al.

[11] Patent Number: 5,516,447

[45] Date of Patent: May 14, 1996

[54] METHOD OF PRODUCING GRANULAR SURFACTANTS

[75] Inventors: Volker Bauer, Duesseldorf; Jochen Jacobs, Wuppertal; Ditmar Kischkel, Monheim; Peter Kraeplin, Genthin; Andreas Syldath, Duesseldorf, all of Germany

[73] Assignee: Henkel Kommanditgesellschaft auf Aktien, Duesseldorf, Germany

[21] Appl. No.: 196,141

[22] PCT Filed: Aug. 11, 1992

[86] PCT No.: PCT/EP92/01831

§ 371 Date: Feb. 22, 1994

§ 102(e) Date: Feb. 22, 1994

[87] PCT Pub. No.: WO93/04162

PCT Pub. Date: Mar. 4, 1993

[30] Foreign Application Priority Data

Aug. 20, 1991 [DE] Germany ..... 41 27 323.0

[51] Int. Cl.[6] ..... C11D 11/00; C11D 17/00

[52] U.S. Cl. ..... 252/89.1; 252/104; 252/135; 252/174; 252/531; 252/550; 23/313 R; 23/313 FB

[58] Field of Search ..... 252/89.1, 135, 252/104, 174; 23/313 R, 313 FB

[56] References Cited

U.S. PATENT DOCUMENTS

| | | | |
|---|---|---|---|
| 3,703,772 | 11/1972 | McHugh et al. | 34/9 |
| 3,734,287 | 5/1973 | Jager | 209/139 A |
| 3,915,878 | 10/1975 | Yurko et al. | 252/89 |
| 4,487,710 | 12/1984 | Kaminsky | 252/546 |
| 4,726,908 | 2/1988 | Kruse et al. | 252/91 |
| 4,828,721 | 5/1989 | Bollier et al. | 252/8.7 |
| 4,867,972 | 9/1989 | Girardeau et al. | 424/81 |
| 5,030,400 | 7/1991 | Danielsen et al. | 264/101 |

FOREIGN PATENT DOCUMENTS

| | | |
|---|---|---|
| 0191396 | 8/1986 | European Pat. Off. . |
| 0364881 | 4/1990 | European Pat. Off. . |
| 0403148 | 12/1990 | European Pat. Off. . |
| 0402111 | 12/1990 | European Pat. Off. . |
| 0402112 | 12/1990 | European Pat. Off. . |
| 0542131 | 5/1993 | European Pat. Off. . |
| 0140987 | 4/1980 | Germany . |
| 9201036 | 1/1992 | WIPO . |

*Primary Examiner*—Paul Lieberman
*Assistant Examiner*—Lorna M. Douyon
*Attorney, Agent, or Firm*—Ernest G. Szoke; Norvell E. Wisdom; Real J. Grandmaison

[57] ABSTRACT

A process for the production of washing- and cleaning-active surfactant granules containing 60 to 70% by weight of surfactant and having an apparent density above 500 g/l, wherein a formulation containing a non-surface-active liquid component and having a liquid to paste-like form under normal pressure at temperatures of 20° to 40° C. is introduced to a fluidized bed and granulated and, at the same time, totally or partially freed from the non-surface-active liquid compound, optionally with addition of an inorganic or organic solid, and wherein the granules are discharged from the fluidized bed via a grading step by a countercurrent air-stream which is adjusted so that only particles above a predetermined size are removed from the granules.

9 Claims, No Drawings

METHOD OF PRODUCING GRANULAR SURFACTANTS

FIELD OF THE INVENTION

This invention relates to a process for converting liquid to paste-like formulations of washing- and cleaning-active surfactant compounds into storable and dust-free granules of high apparent density.

STATEMENT OF RELATED ART

The economic synthesis of light-colored surfactant powders, more particularly anionic surfactants based on fatty alkyl sulfates ("FAS") and alkyl benzenesulfonates ("ABS"), is now established knowledge among experts. The corresponding surfactant salts are obtained as water-containing products having water contents in the range from about 20 to 80% by weight and, more particularly, around 35 to 60% by weight. Products of this type have a paste-like to cuttable consistency at room temperature, whereby the flowability and pumpability of such pastes is limited or lost at room temperature despite an active substance content of only about 50% by weight, so that considerable problems arise in the storage and subsequent processing of the pastes, particularly during their incorporation in mixtures, for example in detergents. Accordingly, there has long been a need to provide detergent-quality surfactants in a dry and, in particular, free-flowing form. Although free-flowing surfactant powders, for example free-flowing FAS powders, can actually be obtained by conventional drying, for example in a spray drying tower, serious limitations have been observed in this regard, jeopardizing above all the economy of using the powders thus obtained, particularly FAS powders, on an industrial scale. Spray-dried FAS powder, for example, has a very low apparent density, so that unprofitable circumstances prevail in the packaging and marketing of these powders or, alternatively, the powders have to be compacted by granulation to relatively heavy granules. However, even in the production of the so-called tower powders, safety considerations can necessitate such restricted operation of the spray drying process that practical difficulties arise. Thus, investigations into the safety aspects of tower powders based on FAS containing 20% by weight or more of active substance have shown that the spray drying of such formulations is possible to only a very limited extent and, for example, requires tower entry temperatures below 200° C. Another disadvantage of spray drying lies in the fact caking can occur in the tower and lead to brown discoloration of the powder.

Comparable or other difficulties arise in the conversion of water-based, more particularly paste-like, formulations of many other washing- and cleaning-active surfactant compounds into storable solids. Further examples of anionic oleochemical surfactant compounds are the known sulfofatty acid methyl esters (fatty acid methyl ester sulfonates, "MES") which are produced by α-sulfonation of the methyl esters of fatty acids of vegetable or animal origin predominantly containing 10 to 20 carbon atoms in the fatty acid molecule and subsequent neutralization to water-soluble monosalts, more particularly the corresponding alkali metal salts. Ester cleavage thereof gives the corresponding sulfofatty acids or their disalts which have important washing and cleaning properties in the same way as mixtures of disalts and sulfofatty acid methyl ester monosalts. However, comparable problems also arise with other classes of surfactants when attempts are made to produce the corresponding surface-active raw materials in dry form, as is the case with cleaning-active alkyl glycoside compounds. To obtain fight-colored reaction products, their synthesis generally has to be following by bleaching, for example with aqueous hydrogen peroxide, so that in this case, too, modern technology leads to the aqueous paste form. Water-containing alkyl glycoside pastes (APG pastes) are more vulnerable, for example, to hydrolysis or microbial contamination than corresponding dry products. In their case, too, simple drying by known methods involves considerable difficulties. Finally, the drying of a water-containing paste of the alkali metal salts of washing-active soaps and/or of ABS pastes can also present considerable problems.

An alternative to the spray drying of surfactant pastes is granulation. Thus, European patent application EP 403 148 describes a process for the production of FAS granules which are dispersible in cold water. In this process, a highly concentrated aqueous FAS paste containing less than 14% by weight of water and less than 20% by weight of other additives is mechanically treated at temperatures of 10° to 45° C. until granules are formed. Although FAS granules dispersible at washing temperatures of only 4° to 30 ° C. are obtained in this way, the process temperatures to be maintained and the relatively low maximum water content of the surfactant paste do represent critical process parameters. In addition, the apparent densities of the granules obtained by this process are not mentioned.

European patent application EP 402 112 describes a process for the production of FAS and/or ABS granules comprising neutralization of the anionic surfactants in acid form to a paste containing at most 12% by weight of water with addition of auxiliaries, such as polyethylene glycols, ethoxylated alcohols or alkylphenols having a melting point above 48° C., and granulation in a high-speed mixer. The quantity of water to be used is again a critical process parameter. In addition, the apparent densities of the surfactant granules obtained by this process are not mentioned.

European patent application EP 402 111 describes a process for the production of washing- and cleaning-active surfactant granules having an apparent density of 500 to 1200 g/l, in which a fine-particle solid is added to a surfactant formulation which contains water as liquid component and which may also contain organic polymers and builders and the whole is granulated in a high-speed mixer. In this case, too, the water content of the surfactant paste is a critical process parameter. If the water content of the surfactant paste is too high, the solid is dispersed so that it can no longer act as a deagglomerating agent. If, on the other hand, the solids content exceeds a certain value, the mixture does not have the necessary consistency for granulation.

DETAILED DESCRIPTION OF THE INVENTION

OBJECT OF THE INVENTION

The problem addressed by the present invention was to provide a process for the production of heavy, free-flowing surfactant granules in which the presence of a non-surface-active liquid component would not be a critical process parameter.

SUMMARY OF THE INVENTION

Accordingly, the present invention relates to a process for the production of washing- and cleaning-active surfactant granules having an apparent density above 500 g/l by granulation of a surfactant formulation containing a non-surface-active liquid component, in which a surfactant formulation present in liquid to paste-like form under normal pressure at temperatures of 20° to 40° C. is granulated and at the same time dried, optionally with addition of an inorganic or organic solid.

The process according to the invention has the advantage that it is not confined to the production of granules of only a few surfactants, so that free-flowing granules of anionic, nonionic, amphoteric, cationic surfactants and mixtures thereof can be produced by this process, the composition of the granules being determinable in advance. The production of anionic or nonionic surfactants or mixtures of anionic surfactants and nonionic surfactants is preferred. In particular, the process according to the invention has advantages over spray drying because granules containing nonionic surfactants, which are not accessible to spray drying on account of their known pluming behavior, can also be produced by the process according to the invention. In addition, no browning of the granules occurs by virtue of the preferably relatively low process temperatures and the gentle drying conditions.

DESCRIPTION OF PREFERRED EMBODIMENTS

In a first embodiment, the surfactant formulation used in accordance with the invention, which is present in liquid to paste-like form under normal pressure at temperatures of 20° to 40° C., contains a mixture of one or more surfactants and a non-surface-active liquid component containing organic and/or inorganic constituents. In another embodiment, the surfactant formulation consists of at least two separate parts of which the first contains a mixture of one or more surfactants and a non-surface-active liquid component containing organic and/or inorganic constituents while the second or following parts either contain one or more surfactants present in liquid to paste-like form under normal pressure at temperatures of 20° to 40° C., which are at least partly different from the surfactants of the first part, or another mixture of one or more surfactants, which are at least partly different from the surfactants of the first part, and a non-surface-active liquid component containing organic and/or inorganic constituents. In another embodiment of the invention, at least one constituent of the non-surface-active liquid component is not incorporated in the above-mentioned surfactant-containing parts of the surfactant formulation, but instead is separately added. However, so far as the quantitative data (based on the surfactant formulation) mentioned in the following are concerned, it is assumed that both the individual surfactant-containing parts of the surfactant formulation and constituents of the non-surface-active liquid component, which are added separately and not in the form of a homogeneous mixture with surfactants, are optionally included in the surfactant formulation.

The non-surface-active liquid component, which may contain one or more constituents, has a boiling point or rather a boiling range under normal pressure of preferably below 250° C. and, more preferably, below 200° C. In a particularly advantageous embodiment, the non-surface-active liquid component contains constituents which boil at 60° to 180° C. under normal pressure. Monohydric and/or polyhydric alcohols, for example methanol, ethanol, propanol, isopropanol, butanol, secondary and tertiary butanol, pentanol, ethylene glycol, propane-1,2-diol, glycerol or mixtures thereof are preferably added as the organic constituent optionally present in the non-surface-active liquid component. The percentage content of the mono- and/or polyhydric alcohols used as the non-surface-active liquid component is preferably 0.5 to 10% by weight, based on the surfactant formulation.

However, it is particularly preferred to use water, optionally together with such organic constituents as ethanol, propane-1,2-diol or glycerol, as the inorganic constituent of the non-surface-active liquid component. In this case, the percentage content of water is preferably from 25 to 80% by weight, based on the surfactant formulation. The total percentage content of the non-surface-active liquid component is preferably between 30 and 70% by weight and, more preferably, between 45 and 60% by weight, based on the surfactant formulation.

The anionic surfactants used are, for example, anionic surfactants of the sulfonate and sulfate type. Preferred surfactants of the sulfonate type are $C_{9-13}$ alkyl benzenesulfonates, olefin sulfonates, i.e. mixtures of alkene and hydroxyalkane sulfonates, and also disulfonates of the type obtained, for example, from $C_{12-18}$ monoolefins with a terminal and internal double bond by sulfonation with gaseous sulfur trioxide and subsequent alkaline or acidic hydrolysis of the sulfonation products. Also suitable are alkane sulfonates of the type obtainable from $C_{12-18}$ alkanes by sulfochlorination or sulfoxidation and subsequent hydrolysis or neutralization. In particular, esters of α-sulfofatty acids (ester sulfonates) which are produced by α-sulfonation of the methyl esters of fatty acids of vegetable and/or animal origin containing 10 to 20 carbon atoms in the fatty acid molecule and subsequent neutralization to water-soluble monosalts, for example the α-sulfonated methyl esters of hydrogenated coconut oil, palm kernel oil or tallow fatty acids, and also the α-sulfofatty acids obtainable by ester cleavage and disalts thereof am produced by the process according to the invention. The production of mixtures of the monosalts and disalts with other surfactants, for example with alkyl benzenesulfonates, is also preferred.

Suitable surfactants of the sulfate type are the sulfuric acid monoesters of primary alcohols of natural and synthetic origin, more particularly of fatty alcohols, for example coconut oil fatty alcohols, tallow fatty alcohols, oleyl alcohol, lauryl alcohol, myristyl alcohol, palmityl alcohol or stearyl alcohol, or the $C_{10-20}$ oxoalcohols and those of secondary alcohols having the same chain length. Sulfuric acid monoesters of the alcohols ethoxylated with 1 to 6 moles of ethylene oxide, such as 2-methyl-branched $C_{9-11}$ alcohols containing on average 3.5 moles of ethylene oxide, are also suitable, as are sulfated fatty acid monoglycerides. However, the production of surfactant granules containing $C_{12-18}$ alkyl sulfates (FAS) or $C_{16-18}$ alkyl sulfates (TAS) either on their own or together with other surfactants is particularly preferred.

Other anionic surfactants which may be produced in granular form by the process according to the invention are soaps of natural or synthetic, preferably saturated or ethylenically unsaturated fatty acids. Soap mixtures derived from natural fatty acids, for example coconut oil, palm kernel oil or tallow fatty acids, are particularly suitable. Soap mixtures of which 50 to 100% consist of saturated $C_{12-18}$ fatty acid soaps and 0 to 50% of oleic acid soaps are preferred. Granules containing soap blended with other surfactants are preferably produced by the process according to the invention.

The anionic surfactants may be used in the form of their sodium, potassium, calcium and ammonium salts and also as water-soluble salts of organic bases, such as monoethanolamine, diethanolamine or triethanolamine. They are preferably used in the form of aqueous preparations, more particularly in the form of about 30 to 60% by weight aqueous preparations in which the anionic surfactants accumulate during their production by neutralization of the corresponding acids.

Granules produced by the process according to the invention preferably contain nonionic surfactants, more particularly together with anionic surfactants, for example alkyl benzenesulfonate and/or fatty alkyl sulfate. The nonionic surfactants are preferably derived from liquid ethoxylated, more particularly primary, alcohols preferably containing 9 to 18 carbon atoms and, on average, 1 to 12 moles of ethylene oxide per mole of alcohol, in which the alcohol radical may be linear or methyl-branched in the 2 position or may contain a mixture of linear and methyl-branched radicals such as is normally present in oxoalcohol radicals. However, linear radicals of $C_{12-18}$ alcohols of natural origin, for example coconut oil alcohol, tallow fatty alcohol or oleyl alcohol, are particularly preferred. The degrees of ethoxylation mentioned are statistical mean values which, for a specific product, may be a whole number or a mixed number. Preferred alcohol ethoxylates are the so-called narrow-range ethoxylates ("NRE"). Alcohol ethoxylates containing on average 2 to 8 ethylene oxide groups are particularly preferred. Preferred ethoxylated alcohols include, for example, $C_{9-11}$ oxoalcohol containing 7 EO, $C_{13-15}$ oxoalcohol containing 3 EO, 5 EO or 7 EO and, more particularly, $C_{12-14}$ alcohol containing 3 EO or 4 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO.

In addition, the granules produced by the process according to the invention may contain as nonionic surfactants alkyl glycosides corresponding to the general formula $R—O—(G)_x$, in which R is a primary linear or 2-methyl-branched aliphatic radical containing 8 to 22 and preferably 12 to 18 carbon atoms, G is a symbol which stands for a glycose unit containing 5 or 6 carbon atoms and the degree of oligomerization x is between 1 and 10, preferably between 1 and 2 and, more preferably, is distinctly smaller than 1.4.

The percentage content of the surfactants in the surfactant formulation as a whole is preferably between 20 and 75% by weight and more preferably between 35 and 70% by weight.

The surfactant formulation preferably contains as further constituents additives which are ingredients of detergents and cleaning products. Surfactant formulations containing additives in quantities of 0.001 to 15% by weight, based on the surfactant formulation as a whole, are preferably used in the process according to the invention. Particularly preferred additives are dyes, foam inhibitors, bleaches and/or solubility-improving constituents.

Suitable dyes are heat-stable dyes, preferably pigments, which are advantageously used in quantities of 0.001 to 0.5% by weight, based on the surfactant formulation.

Suitable foam inhibitors are, for example, soaps of natural and synthetic origin which have a high percentage content of $C_{18-24}$ fatty acids. Suitable non-surface-active foam inhibitors are organopolysiloxanes and mixtures thereof with microfine, optionally silanized silica, paraffins, waxes, microcrystalline waxes and mixtures thereof with silanized silica. Bis-acylamides derived from $C_{12-20}$ alkyl amines and $C_{2-6}$ dicarboxylic acids may also be used. Mixtures of different foam inhibitors, for example foam inhibitors of silicones and paraffins or waxes, may also be used with advantage. The foam inhibitors are preferably fixed to a granular carrier material soluble or dispersible in water. The content of foam inhibitors in the surfactant formulation is preferably between 0.01 and 0.5% by weight.

Among the compounds yielding $H_2O_2$ in water which serve as bleaches, sodium perborate tetrahydrate and sodium perborate monohydrate are particularly important. Other useful bleaches are, for example, peroxycarbonate, peroxypyrophosphates, citrate perhydrates, peroxyphthalates, diperazelaic acid or diperdodecanedioic acid. In particular, hydrogen peroxide is also preferably used as bleach in the surfactant formulations used in accordance with the invention. The bleach content of the surfactant formulations is preferably from 0.5 to 15% by weight. More particularly, the hydrogen peroxide content is from 0.5 to 5% by weight.

Solubility-improving constituents include liquid, paste-form and solid compounds which are soluble or dispersible in the other constituents of the surfactant formulation. Polyethylene glycols having a relative molecular weight of 200 to 20,000 and highly ethoxylated fatty alcohols containing 14 to 80 ethylene oxide groups per molecule, more particularly $C_{12-18}$ fatty alcohols containing 20 to 60 ethylene oxide groups, for example tallow fatty alcohol containing 30 EO or 40 EO, are preferably used as the solubility-improving constituents. It is particularly preferred to use polyethylene glycols having a relative molecular weight of 200 to 600. These polyethylene glycols are advantageously used as a separate constituent of the non-surface-active liquid component. The percentage content of these constituents, which improve the solubility of the granules, in the surfactant formulation is preferably from 1 to 15% by weight and, more preferably, from 2 to 10% by weight.

The surfactant formulation is granulated and dried at one and the same time. By "drying" is meant the partial or complete removal of the non-surface-active liquid component. If desired, residues of free, i.e. unbound, water and/or monohydric and/or polyhydric alcohols may be present as long as the granules remain free-flowing and non-tacky. However, the free water content preferably does not exceed 10% by weight and, more preferably, does not exceed 0.1 to 2% by weight, based on the final granules.

According to the invention, the surfactant granules may be produced in any machines in which granulation and drying can be carried out at one and the same time. Examples of such machines are heatable mixers and granulators, more particularly granulators of the Turbo Dryer® type (manufacturer: Vomm, Italy). In one preferred embodiment of the invention, however, the steps of granulation and drying are carried out together in a batch-type or continuous fluidized bed. In a particularly preferred embodiment, the process is carried out continuously in a fluidized bed. To this end, the surfactant formulation or the individual constituents of the surfactant formulation may be introduced into the fluidized bed simultaneously or successively through a single nozzle, for example a multiple-bore nozzle, or through several nozzles. However, it is also possible simultaneously and separately to add a constituent of the non-surface-active liquid component which was not incorporated in the surfactant formulation. The nozzle or nozzles and spraying direction for the products to be sprayed may be arranged in any way. Preferred fluidized bed machines have base plates measuring at least 0.4 m. Particularly preferred fluidized beds have a base plate from 0.4 to 5 m in diameter, for example 1.2 m or 2.5 m in diameter. However, fluidized beds having a base plate larger than 5 m in diameter are also suitable. The base plate used is preferably a perforated plate or a so-called Conidur plate (a product of Hein & Lehmann, Federal Republic of Germany). The process according to the invention is preferably carried out at flow rates of the fluidizing air of 1 to 8 m/s and, more particularly, 1.5 to 5.5 m/s. The granules are advantageously discharged from the fluidized bed via a grading stage. Grading may be carried out, for example, by means of a sieve or by a countercurrent air stream (sizing air) which is adjusted in such a way that only particles beyond a certain size are removed from the fluidized bed while smaller particles are retained therein. In one preferred embodiment, the in-flowing air is made up of the heated or unheated sizing air and the heated base air. The temperature of the air at the base plate is preferably between 80° and 400° C. and, more preferably, between 90° and 350° C. The fluidizing air is cooled by heat loss and by the heat of evaporation of the constituents of the non-surface-active liquid component. In one particularly preferred embodiment, the temperature of the fluidizing air about 5 cm above the base plate is 60° to 120° C., preferably 65° to 90° C. and, more preferably, 70° to 85° C. The air exit temperature is preferably between 60° and 120° C., more particularly below 100° C. and, with particular advantage, between 70° and 85° C. In the preferred fluidized-bed process, a starting material serving as initial carrier for the surfactant formulation sprayed in must be present at the beginning of the process. Suitable starting materials are, above all, ingredients of detergents, more particularly those which may also be used as solids in the process according to the invention and which have a particle size distribution substantially corresponding to the particle size distribution of the final granules. In a particularly preferred embodiment, however, surfactant granules obtained in a previous run of the process are used as the starting material.

In the fluidized bed, the constituents of the non-surface-active liquid component undergo complete or partial evaporation. Partially dried to fully dried nuclei are formed and are coated with further quantities of the surfactant formulation introduced, granulated and, at the same time, dried.

In one particularly important embodiment, the formulation is granulated and, at the same time, dried with addition of an inorganic or organic solid which may be pneumatically introduced through blow pipes. This solid, which serves as carrier for the surfactant formulation, preferably consists of ingredients of detergents. Suitable solids are, for example, surfactants and surfactant mixtures which have been produced by granulation, by spray drying or by the process according to the invention and which are recycled to increase the surfactant concentration in the final granules. It is particularly preferred to use spray-dried surfactant granules and/or surfactant granules obtained by the process according to the invention. Highly ethoxylated fatty alcohols, for example containing 20 to 80 EO and preferably 20 to 60 EO, more particularly tallow fatty alcohol containing 30 or 40 EO, may also be used with advantage as solids as an alternative to incorporation in the surfactant formulation.

In another preferred embodiment, the solids used are non-surface-active ingredients of detergents and cleaning preparations, preferably one or more constituents from the group consisting of alkali metal carbonates, alkali metal sulfates, crystalline and amorphous alkali metal silicates and layer silicates and also zeolites, more particularly detergent-quality zeolite NaA, salts of citric acid, solid peroxy bleaches and, optionally, bleach activators and solid polyethylene glycols having a relative molecular weight of, or more than, 2000, more particularly between 4000 and 20,000.

The solids used are preferably fine-particle materials which can either be directly produced or purchased as such or which may be convened into the fine-particle state by standard methods of size reduction, for example by grinding in typical mills. Preferred solids contain, for example, no more than 5% by weight of particles larger than 2 mm in diameter and preferably no more than 5% by weight of particles larger than 1.6 mm in diameter. Solids of which at least 90% by weight consist of particles smaller than 1.0 mm in diameter are particularly preferred. Examples of such solids are alkali metal carbonates containing more than 90% by weight of particles 0.5 mm or smaller in diameter and detergent-quality zeolite NaA powder containing at least 90% by weight particles smaller than 0.03 mm in diameter. In a particularly advantageous embodiment, the solids added are used in quantities of 10 to 50% by weight and, more particularly, in quantities of 20 to 45% by weight, based on the sum total of surfactant formulation and solid.

In another preferred embodiment, the invention relates to surfactant granules produced by the process according to the invention. Preferred surfactant granules contain from 10 to 100% by weight, more preferably from 30 to 80% by weight and, with particular advantage, from 40 to 70% by weight of surfactants, based on the final granules. Pure surfactant granules are obtained if the non-surface-active liquid component is completely evaporated so that the granules are completely dried and the solid optionally added consists of a pure surfactant material. In this case, surfactant granules produced by the process according to the invention and used as solid in the process according to the invention are optionally size-reduced to the required particle size distribution and recycled. The surfactant content of the granules may be adjusted to any of the required values.

The surfactant granules obtained by the process according to the invention preferably have an apparent density of 550 to 1000 g/l and, more preferably, 550 to 850 g/l and are dust-free, i.e. they contain no particles smaller than 50 μm in size. The particle size distribution of the surfactant granules otherwise corresponds to the typical particle size distribution of a heavy state-of-the-an detergent. More particularly, (he surfactant granules have a particle size distribution in which at most 5% by weight and preferably at most 3% by weight of the particles are larger than 2.5 mm in diameter and at most 5% by weight and, with particular advantage, at most 3% by weight of the particles are below 0.1 mm in diameter. The surfactant granules are distinguished by their light color and by their flowability. No further measures need be taken to prevent the surfactant granules produced in accordance with the invention from adhering to one another. If desired, however, the process according to the invention may be followed by an additional step in which the surfactant granules are dusted in known manner with fine-particle materials, for example with zeolite NaA or soda, in order further to increase their apparent density. This dusting or powdering may be carried out, for example, during a rounding step. However, preferred surfactant granules already have such a regular and, in particular, substantially spherical structure that a rounding step is generally unnecessary and, hence, is also not preferred.

EXAMPLES

In Examples 1 to 10, a surfactant formulation which could consist of one or more separate parts was granulated and, at the same time, dried together with a solid via a nozzle in a combined granulating and drying machine (manufacturer: Glatt, Federal Republic of Germany). The starting material used consisted of surfactant granules which had been obtained in a preceding batch (under the same process conditions) and which had substantially the same composition as the final granules of Examples 1 to 10. The process conditions are shown in Table 1.

The following substances were used in the surfactant formulation:

| | |
|---|---|
| Sulfopon ® T 55 | containing 54% by weight of tallow fatty alcohol sulfate and about 41% by weight of water (a product of Henkel KGaA) |
| Texapon ® LS 35 | containing 34% by weight of $C_{12-14}$ fatty alcohol sulfate and about 64% by weight of water (a product of Henkel KGaA) |
| Dehydrol ® LT 7 | containing 99% by weight of $C_{12-18}$ fatty alcohol.7 EO (a product of Henkel KGaA) |
| Texin ® ES 68 | containg 53% by weight of sodium monosalt of tallow fatty acid methyl ester, 11% by weight of disodium salt of sulfotallow fatty acid and about 33% by weight of water (a product of Henkel KGaA) |
| PEG 400 | polyethylene glycol having a relative molecular weight of 400. |

These constituents were introduced separately and simultaneously into the fluidized bed through a nozzle.

The following solids were used:

| | |
|---|---|
| Soda | sodium carbonate having an apparent density of 620 g/l (a product of Matthes & Weber, Federal Republic of Germany) |
| Wessalith ® P | zeolite powder (a product of Degussa, Federal Republic of Germany) |
| Carrier bead | zeolite granules containing 67% by weight zeolite (counted as anhydrous), 11% by weight of a polymeric polyacrylate, 1.85% by weight of tallow fatty alcohol.5 EO, 2% by weight sodium sulfate and 17% by weight of water |
| Citrate trisodium citrate EP powder (dihydrate, a product of Jungbunzlauer, Federal Republic of Germany) | |
| Sulfopon ® T | tallow fatty alcohol sulfate powder (a product of Henkel KGaA) |
| B 5 | ground product of Example 5 (particle size distribution same as Sulfopon ® T) |

Dust-free non-tacky granules of high surfactant content were obtained in all the Examples (see Table 2). The percentage content of granules larger than 2.5 mm in size was below 5% by weight in all the Examples.

TABLE 1

Process parameters

| | Examples | | | | | | | | | |
|---|---|---|---|---|---|---|---|---|---|---|
| | 1 | 2 | 3 | 4 | 5 | 6 | 7 | 8 | 9 | 10 |
| Fluidized bed | | | | | | | | | | |
| diameter in mm | 400 | 1200 | 1200 | 400 | 400 | 400 | 400 | 400 | 400 | 400 |
| surface area in $m^2$ | 0.13 | 0.13 | 0.13 | 0.13 | 0.13 | 0.13 | 0.13 | 0.13 | 0.13 | 0.13 |
| Fluidizing air flow rate in m/s (under operating conditions) | 5.1 | 2.35 | 2.62 | 2.8 | 2.6 | 2.6 | 2.7 | 2.6 | 2.6 | 2.6 |
| Temperatures in °C. | | | | | | | | | | |
| air at base plate | 100 | 126 | 175 | 132 | 137 | 137 | 150 | 130 | 160 | 160 |
| grading air | 20 | 20 | 20 | 20 | 20 | 20 | 20 | 20 | 20 | 20 |
| fluidizing air about 5 cm above the base plate | 81 | 82 | 82 | 77 | 75 | 82 | 89 | 78 | 80 | 76 |
| air exit | 76 | 76 | 77 | 73 | 71 | 75 | 82 | 70 | 73 | 71 |
| Air flow in $m^3/h$ (under operating conditions) | 2341 | 9563 | 10685 | 1300 | 1180 | 1180 | 1220 | 1180 | 1190 | 1190 |
| Air loading (g $H_2O$/kg air) | 3.8 | 10.8 | 31.2 | 11 | 12 | 9.3 | 9.0 | 11 | 14 | 13 |
| Throughput of sufactant formulation in kg/h | | | | | | | | | | |
| Sulfopon ® T 55 | 20 | 180 | 520 | 28 | 42 | 33 | 33 | 40 | 50 | — |
| Texapon ® LS 35 | — | — | — | 10 | — | — | — | — | — | — |
| Dehydol ® LT 7 | — | — | — | — | — | — | — | 3 | — | — |
| Texin ®ES 68 | — | — | — | — | — | — | — | — | — | 30 |
| PEG 400 | — | — | — | — | — | 3 | — | — | — | — |
| Throughput of solids in kg/h | 12 | 60 | 370 | 19 | — | — | 5.4 | — | — | — |
| Wessalith ® P | — | — | — | — | — | — | 13.6 | — | — | — |
| Carrier bead | — | — | — | — | — | — | — | — | — | 25 |
| Citrate | — | — | — | — | — | — | — | — | 15 | — |
| Sulfopon ® T | — | — | — | — | 20 | — | — | 20 | — | — |
| B 5 | — | — | — | — | — | 19 | — | — | — | — |
| Starting material in kg | 25 | 120 | 120 | 20 | 20 | 20 | 20 | 20 | 20 | 20 |

TABLE 2

Characteristic data of the products

| | Examples | | | | | | | | | |
|---|---|---|---|---|---|---|---|---|---|---|
| | 1 | 2 | 3 | 4 | 5 | 6 | 7 | 8 | 9 | 10 |
| Total surfactant content in % by weight | 45.5 | 66.0 | 45.7 | 47 | 87 | 83 | 46 | 80.2 | 56.8 | 29.3 |

TABLE 2-continued

| | Characteristic data of the products | | | | | | | | | |
|---|---|---|---|---|---|---|---|---|---|---|
| | Examples | | | | | | | | | |
| | 1 | 2 | 3 | 4 | 5 | 6 | 7 | 8 | 9 | 10 |
| Water content in % by weight | <1 | <1 | <1 | <1 | <1 | <1 | 7.2* | <1 | 4.8 | <1 |
| Apparent density in g/l | 790 | 615 | 580 | 630 | 512 | 540 | 655 | 505 | 675 | 685 |
| Sieve analysis in % by weight | | | | | | | | | | |
| 2.5 mm | — | — | 1.9 | — | — | — | — | — | — | — |
| 1.6 mm | 97.2 | 6.1 | 17.1 | 9.8 | 24.9 | 27.0 | 0.3 | 13.1 | 0.7 | 4.8 |
| 0.8 mm | 2.8 | 6.2 | 14.0 | 44.4 | 72.8 | 64.0 | 38.1 | 86.0 | 51.3 | 23.0 |
| 0.6 mm | 0.0 | 7.9 | 57.7 | 23.6 | 1.0 | 5.4 | 48.4 | 0.8 | 38.6 | 14.7 |
| 0.4 mm | — | 23.7 | 8.4 | 16.4 | 0.6 | 2.8 | 12.0 | 0.1 | 8.6 | 18.7 |
| 0.2 mm | — | 40.2 | 0.9 | 4.8 | 0.4 | 0.6 | 0.9 | — | 0.6 | 22.0 |
| 0.1 mm | — | 14.0 | — | 1.0 | 0.3 | 0.2 | 0.2 | — | 0.2 | 14.3 |
| 0.05 mm | — | 1.8 | — | — | — | — | 0.1 | — | — | 2.5 |
| <0.05 mm | — | — | — | — | — | — | — | — | — | — |

*Including water from zeolite

The invention claimed is:

1. A process for the production of washing- and cleaning-active surfactant granules, wherein said granules are prepared from a composition consisting of 40 to 70% by weight of surfactant and reciprocally 60–30% by weight of a non-surface-active liquid component, and having a liquid to paste-like form under normal pressure at temperatures of 20° to 40° C., said composition being introduced to a fluidized bed and granulated and, at the same time, totally or partially freed from the non-surface-active liquid component, optionally with addition of: (a) 0.5 to 10% by weight, based on the surfactant composition, of mono- or polyhydric alcohols, (b) 0.001 to 15% by weight, based on the surfactant composition, of dyes or foam inhibitors, and (c) 10 to 50% by weight, based on the sum total of surfactant composition and solid, of solid additives selected from the group consisting of alkali metal carbonates, alkali metal sulfates, zeolite, salts of citric acid, peroxy bleaches, bleach activators, polyethylene glycols having a relative molecular weight in the range from 4000 to 20,000 and ethoxylated fatty alcohols containing 20 to 80 ethylene oxide groups to the surfactant composition, and wherein the granules are discharged from the fluidized bed via a grading step by a countercurrent air-stream which is adjusted so that only particles smaller than 50 μm in size are removed from the granules, said granules having an apparent density above 500 g/l.

2. A process as claimed in claim 1, wherein the surfactant composition consists of surfactants or surfactant mixtures selected from the group consisting of fatty alkyl sulfates, $C_9$–$C_{13}$ alkyl benzenesulfonates and sulfofatty acid methyl esters, and liquid ethoxylated fatty alcohols containing 2 to 8 ethylene oxide groups per molecule.

3. A process as claimed in claim 1 wherein the surfactant composition consists of at least two separate parts of which the first contains a mixture of one or more surfactants and a non-surface-active liquid component while the second or following parts either contain one or more surfactants present in liquid to paste-like form under normal pressure at temperatures of 0° to 40° C., which are at least partly different from the surfactants of the first part, or another mixture of one or more surfactants, which are at least partly different from the surfactants of the first part, and a non-surface-active liquid component.

4. A process as claimed in claim 1, wherein the non-surface-active liquid component boils between 60° and 180° C. under normal pressure.

5. A process as claimed in claim 4 wherein water is used as the non-surface-active liquid component.

6. A process as claimed in claim 1, wherein the surfactant composition consisting of said surfactant and said non-surface-active liquid component is dried and, at the same time, totally or partially freed from the non-surface-active liquid component in a fluidized bed either in batches or continuously, the fluidized bed being fluidized by flowing air.

7. A process as claimed in claim 6, wherein the surfactant composition or individual parts of the surfactant composition are simultaneously or successively introduced into the fluidized bed through a single nozzle or through several nozzles.

8. A process as claimed in claim 6, wherein the fluidizing air flows at a rate between 1.5 and 5.5 m/s.

9. A process as claimed in claim 6, wherein the fluidized bed is formed in a machine with a base plate, the air temperature at the base plate is between 90° and 350° C.; the temperature of the fluidizing air about 5 cm above the base plate is between 65° and 90° C.; and the air exit temperature is between 60° and 100° C.

* * * * *